US006327340B1

(12) United States Patent
Runnoe

(10) Patent No.: US 6,327,340 B1
(45) Date of Patent: Dec. 4, 2001

(54) COOLED X-RAY TUBE AND METHOD OF OPERATION

(75) Inventor: Dennis Runnoe, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/430,482

(22) Filed: Oct. 29, 1999

(51) Int. Cl.[7] ..... H01J 35/10
(52) U.S. Cl. ..... 378/130; 378/132
(58) Field of Search ..... 378/125–133

(56) References Cited

U.S. PATENT DOCUMENTS

| | | | |
|---|---|---|---|
| 4,115,697 | 9/1978 | Hounsfield et al. | 250/445 T |
| 4,622,687 | 11/1986 | Whitaker et al. | 378/130 |
| 4,709,559 | 12/1987 | Dotzauer et al. | 62/499 |
| 5,018,181 | 5/1991 | Iversen et al. | 378/144 |
| 5,541,975 | 7/1996 | Anderson et al. | 378/130 |
| 5,689,542 | 11/1997 | Lavering et al. | 378/142 |
| 5,737,387 | 4/1998 | Smither | 378/130 |
| 6,002,745 | 12/1999 | Miller et al. | 378/128 |
| 6,074,092 | 6/2000 | Andrews | 378/200 |
| 6,115,454 | 9/2000 | Andrews et al. | 378/140 |
| 6,125,169 | 9/2000 | Wandke et al. | 378/143 |

*Primary Examiner*—Craig E. Church
(74) *Attorney, Agent, or Firm*—Workman, Nydegger & Seeley

(57) ABSTRACT

The present invention is directed to a cooling system and apparatus for use in x-ray tubes. In operation x-ray tubes generate large amounts of heat. The disclosed device includes a liquid metal cooling system applied to the anode of the x-ray tube and a contactless magnetic bearing. The magnetic bearing suspends the anode. The anode is connected thermally through the liquid metal cooling system.

51 Claims, 5 Drawing Sheets

COOLED X-RAY TUBE AND METHOD OF OPERATION

BACKGROUND OF THE INVENTION

1. The Field of the Invention

The present invention generally relates to an apparatus and system for removing excess heat generated in electrical components. More particularly, the present invention relates to an apparatus and method for removing heat from a magnetically suspended rotating anode inside an x-ray tube using liquid metals, the x-ray tube being for use in systems such as CT scanners and the like.

2. The Prior State of the Art

In systems utilizing electrical components, heat is often generated when electrical power is supplied to the component. With some components, the amount of heat generated can be substantial. In such an environment, the dissipated heat must be continuously removed so as to prevent overheating and damage to the components and/or surrounding electrical circuitry. One example of an electrical system in which overheating can be problematic is in systems utilizing high power x-ray tubes for commercial or medical applications. Such tubes are commonly found in various devices, for instance in CT (computerized tomographic) scanning, x-ray lithography for producing integrated circuits, x-ray diffraction for analyzing materials, x-ray detection devices for inspecting luggage, and the like. In such devices and applications, a high power, high intensity x-ray tube is used to produce the radiation. By way of example, a cooled X-ray tube is disclosed in U.S. Pat. No. 5,541,974, issued to Anderson et al. on Jul. 30, 1996, which is incorporated herein by reference.

Depending on the particular application, the radiation can be used in various ways. For instance, in a CT scanner, the radiation can be detected with one or more detectors after it has passed through the region of interest of a patient's body. It is then manipulated to reproduce an image of the anatomical region of interest. In the course of such a procedure, much heat is generated by the x-ray tube as a by-product of the x-ray energy generated. X-rays are emitted from a small portion of the track designate as the focal spot which is bombarded by electrons. The track is situated upon an anode that is rotated within a vacuum tube. The anode is rotated so that cool track material is passed into the focal spot region and heated. The hot material in the focal spot area is likewise moved out of this region to cool. Even though the heat is directed over a relatively large surface area on the track, anodes of high power tubes of this type frequently are heated sufficiently to become incandescent in response to the electron bombardments. X-ray tube anodes typically operate in a range from about zero to 1200° C. At 1200° C., an anode can be visibly red or yellow and readily radiates heat. The heat generated on the anode must be continuously removed to prevent damage to the tube (and any other adjacent components) and to increase the x-ray tube's overall service life. Moreover, applications using x-ray tubes experience the problem of downtime as the user waits for the tube to cool down to useable levels.

A high intensity x-ray anode can transfer heat through radiation from its hot surface or by conduction through connecting materials. Until recently, conventional rotating anodes in high intensity x-ray tubes have only been able to transfer heat through radiation. While radiative cooling transfers heat quickly when the anode is extremely hot (e.g. 1200° C.), the rate of heat transfer drops quickly as the anode cools to temperatures levels which are still too high for efficient operation or generation of x-rays. At high temperatures, such as 1200° C., some materials from which the anode is made can experience problems. The high temperatures can cause shifting of portions of the anode, cracking, distressing, warping, and other material failures. Material failures can result in errors in the resultant x-ray image.

Heat from the rotating anode can be radiated or conducted to the bearing on which the anode rotates. The bearings can be ball bearings. Cyclical heating and cooling of the ball bearings shortens their life, and creates the further problems of unacceptably high noise levels and vibration.

To avoid the foregoing problems known to exist in using ball bearings in which to journal the rotating shaft of an anode, the anode can be magnetically suspended within the vacuum tube and rotated during the x-ray generation process. Using magnetic suspension of the anode within the vacuum tube also can experience problems with heat. Heat from the rotating anode can be radiated or conducted to the bearing on which the anode rotates. Materials that are used to magnetically suspend the anode can be heated near to or above their Curie point so that the materials cease to properly function. The magnetic effect cannot be maintained above the Curie temperature of the materials. Past applications used to cool such materials dealt only with cooling by radiation. As such, these applications have a limitation in terms of their operating parameters in that they cannot properly cool at temperatures below about 500° C. which is near the Curie point of most materials used to generate the suspending magnetic field. As such, x-ray tubes of this variety may not be suitable for use in connection with certain types of CT devices or devices wherein the heat generated by the tube may exceed 500° C.

When it is desirable to operate an x-ray tube at a very high temperature, e.g. above 1000° C., heat is radiated from the anode. To radiate effectively so as to remove the radiated heat, it is desirable to coat the inside of the vacuum tube and other parts therein with an emissive coating. The emissive coating enhances thermal heat radiation properties. At these temperatures emissive coatings are used on the anode and on the vacuum envelope to facilitate the removal of waste heat. The coating, when subjected to high temperatures and large temperature fluctuations, peels, cracks, and flakes and generally releases particles into the tube. These particles cause arcs. An arc is an uncontrolled rush of electrons hitting the target or some other element. The arc causes a disruption in the x-ray production process and in the intended application.

Arcs can also be caused by outgassing within the tube. When a material is heated gas can be evolved from the material. Gas is evolved faster at successively higher temperatures. This is known as outgassing. Accordingly, it is desirable to use materials in the tube that do not outgas at operating temperatures, or to operate the x-ray tube below a temperature at which materials in the tube tend to outgas.

One way of dissipating heat in x-ray tubes is with a liquid coolant or fluid, such as a dielectric oil. In a cooling system of this sort, the x-ray tube is usually disposed within an x-ray tube housing which is filled with coolant. A pump is used to continuously circulate the coolant through the housing. Then, as heat is dissipated by the x-ray tube, at least some of it is absorbed by the coolant fluid. The heated coolant fluid is then passed to some form of heat exchange device, such as a radiative surface in the form of a heat exchanger. Conventional heat exchangers include fins that are air-cooled by air blowing across the fins. The fluid is then re-circulated by the pump back into the x-ray tube housing and the process repeated.

Another way to remove heat is to blow air directly on the surface of the housing which may have its surface area enhanced with the addition of fins.

Yet another way to remove heat is to blow air directly on the surface of the vacuum tube and forego the use of coolant inside the housing entirely.

It is difficult to remove heat from the anode by conduction when it is rotating. This can be done, however, by putting the rotating anode in contact with liquid metal. In this technique, heat is removed from the anode by the placement of a relatively high thermal conductive liquid metal in the thermal pathway between the rotating anode and a stationary heat removing structure. The liquid metal is usually gallium, indium, tin, or a gallium-indium-tin alloy. Gallium is used because it has a sufficiently low vapor pressure to be compatible with the low pressures within the vacuum tube. Prior art liquid metal cooling apparatus fail to adequately cool the anode in high energy applications in that they lack a high conductivity heat path from the track surface of the anode, through the liquid metal, and then to a high conductivity heat exchanger.

SUMMARY AND OBJECTS OF THE INVENTION

It is therefore an object of the present invention to provide a new and improved x-ray tube having a magnetically suspended rotating anode. When impinged with high velocity electrons, the anode generates x-rays and high amounts of heat. Therefore, it is a related objective of the present invention to provide an x-ray tube in which the rotating anode is conductively cooled with the aid of a liquid metal.

These, as well as other objectives, are achieved with embodiments of the present invention, which are directed to an inventive x-ray generation device. The device includes an evacuated tube having an anode and a cathode disposed therein. A contactless bearing is provided for magnetically journaling the anode, along with a device for axially rotating the anode within the contactless bearing. A liquid metal is then confined within a fixed configuration so as to be in contact with the anode and absorb thermal heat from the anode during operation. Optionally, an embodiment can also have a second liquid metal that is in thermal heat conduction relation with the first liquid, so as to provide for an enhanced heat removal.

In another preferred embodiment, the rotating anode is configured with a heat flow design that maximizes the flow of waste heat from the track area to the heat removal area. A magnetic suspension device is used to support, rotate and position the rotating anode. A heat removal device, consisting of a liquid metal, such as gallium, is held in contact with the rotating anode in a heat removal area within the vacuum tube. The liquid metal can also be held in contact with a stationary heat removal area which is integral to die vacuum tube. The surface area outside the vacuum tube is also a heat removal area which is cooled by conventional means utilizing pumps, coolants, fans, fins and other elements known to this art to remove heat. In this embodiment the magnetic suspension device and the anode are cooled by the heat removal device to prevent either element from reaching temperatures near the Curie point of the magnetic suspension device, e.g. 500° C.

In one embodiment, the magnetic suspension device for the anode may include a feedback system to control the temperature, rotation, and location of the anode within a vacuum tube.

In a still further preferred embodiment of the present invention, the anode is constructed so as to limit the amount of heat transmitted from the anode to the heat removal area, thus causing the anode to increase in temperature as high as 1200° C. In this embodiment, the magnetic suspension devices are thermally shielded from the anode and are simultaneously thermally connected to the heat removal areas in order to keep them at low operating temperatures, thus preventing any materials in the magnetic suspension devices from exceeding their Curie point.

Embodiments of the present invention provide numerous and beneficial utility to medical imaging operations. Since the anode is placed in contact with a liquid metal that thermally conducts heat away from the anode, it can be operated at temperatures that do not exceed 500° C. Because of the lower operating temperatures, the x-ray generator is capable of performing multiple slice scanning operations in the making of x-ray CT images without overheating.

Additional objects, features and advantages of the invention will be set forth in the description which follows, and in part will be obvious from the description, or may be learned by the practice of the invention.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings in which like reference numerals designate like structures. Understanding that these drawings (depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
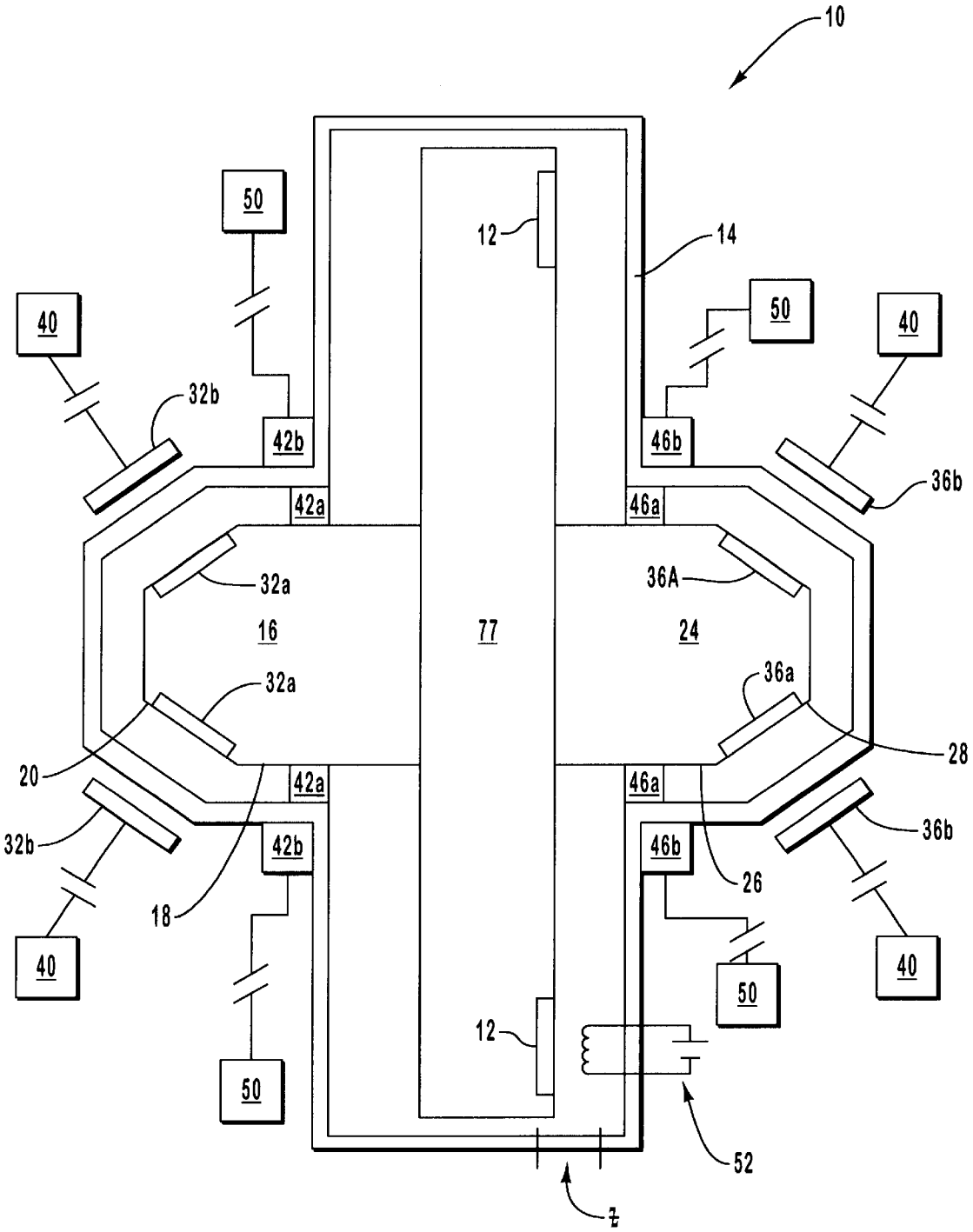
FIG. 1 is a cross sectional drawing of one preferred embodiment of the present invention showing an x-ray tube having a mechanism to remove the heat therefrom, and including a rotary anode that is magnetically suspended with a vacuum tube, where the anode is cooled, in part, by a first liquid metal having an interface with both the tube and the anode and the first liquid are cooled by a second liquid including a metal having an interface with the tube and with a conventional heat exchanger.

Reference is now made to the drawings which are not necessarily drawn to scale. FIG. 1 illustrates, in cross section, a schematic representation of an example of type of high intensity x-ray tube that requires continuous heat removal, and in which the current invention finds particular application. During a typical procedure, the high intensity x-ray tube generates a beam of radiation through an x-ray port, seen in FIG. 1 at reference Z, to the patient. This beam of radiation is then rotated around the patient's body by rotating a gantry. Radiation detectors, which are disposed about the patient, are then used to detect the intensity of the resultant radiation beam. This information can then be used to generate an image of the patient's body in a manner that is well known in the art. As already discussed in the background section, in the course of generating x-rays, an extreme amount of heat is dissipated by the x-ray tube as a by-product.

FIG. 1 shows an x-ray tube assembly, which is designated generally at 10. A track 12, preferably annular in shape, is positioned on an anode having a disk 77, a left portion 16 and a right portion 24. Also included is a means for emitting electrons towards the focal track 12 on anode disk 77, such as a cathode 52. The anode and the cathode are disposed within a vacuum tube 14. Left portion 16 of the anode has a cylindrical section 18 and a frustoconical section 20 that extends from cylindrical section 18. Right portion 24 of the anode has a similarly shaped cylindrical portion 26 and frustoconical section 28.

In a preferred embodiment, tube 10 includes means for magnetically suspending the anode within the tube. The magnetic suspension means serves as a magnetic bearing in which left and right portions 16, 24 of the anode are journaled. By way of example, and not limitation, the magnetic suspension means is comprised of materials 32*a*, 32*b*, 36*a* and 36*b*. Specifically, left portion 16 of the anode has therein material 32*a* which is magnetically engaged, respectively, with material 32*b* situated outside of vacuum tube 14. Similarly, right portion 24 of the anode has material 36*a* which is magnetically engaged, respectively, with material 36*b* situated outside of vacuum tube 14.

Preferably, materials 32*b* and 36*b* are in communication with a means for rotating the anode within the tube. In one preferred embodiment, the rotating means is comprised of a magnetic suspension feedback system 40. The purpose of the magnetic suspension feedback system 40 is to control the position of the left portion 16 and the right portion 24 of the anode, as well as track 12, within the vacuum tube 14 as the anode is electromagnetically rotated about an axis of the anode. Magnetic suspension feed back system 40 controls the contactless bearing to magnetically move the anode for the purpose of maintaining alignment of the x-ray source. Also, magnetic suspension feed back system 40 magnetically moves the anode to new positions for the purpose of providing multiple origins for the x-rays for multi-slice tomography.

Magnetic suspension device feedback system 40 may also include temperature sensing means for detecting the temperature of materials 32*a* and 36*a*, which affect the magnetic engagement with materials 32*b* and 36*b*, situated outside of vacuum tube 14.

The x-ray tube 10 also preferably includes a first means for thermal heat conduction from an extension surface of the anode. One example of the conduction means is liquid metal 42*a* and 46*a*. More particularly, a liquid including a metal, shown at 42*a*, is disposed about the outer periphery of the left portion 16 of the anode. Similarly, a liquid metal 46*a* is disposed about the outer periphery of the right portion 24 of the anode. Preferably, liquid metal 42*a* and 46*a* are also in contact with an inner surface of vacuum tube 14 as seen in FIG. 1. Examples of the type of metal in the liquid including a metal are gallium, indium, tin, or a gallium-indium-tin alloy. Liquid metal 42*a* and 46*a* provide thermal heat conduction directly from a surface of the anode through direct contact with the anode.

In addition, preferred embodiments further include a second thermal heat conduction means for conducting heat away from the First conduction means, to a point external to the evacuated tube 14. By way of example, FIG. 1 shows how the second thermal heat conduction means can be comprised of liquid metal 42*b* and 46*b*. In this embodiment, heat is conducted from liquid metal 42*a* and 46*a* to liquid 42*b* and 46*b* situated outside of and in contact with vacuum tube 14. Heat that is transferred by thermal conduction to liquids 42*b* and 46*b* is then preferably communicated away from vacuum tube 14 through conventional heat exchangers which are represented in FIG. 1 at reference numeral 50. In this embodiment the tube is preferably operated in the range of 0° C. to 500° C. At this temperature range heat is removed primarily by conduction.

Figure 2:
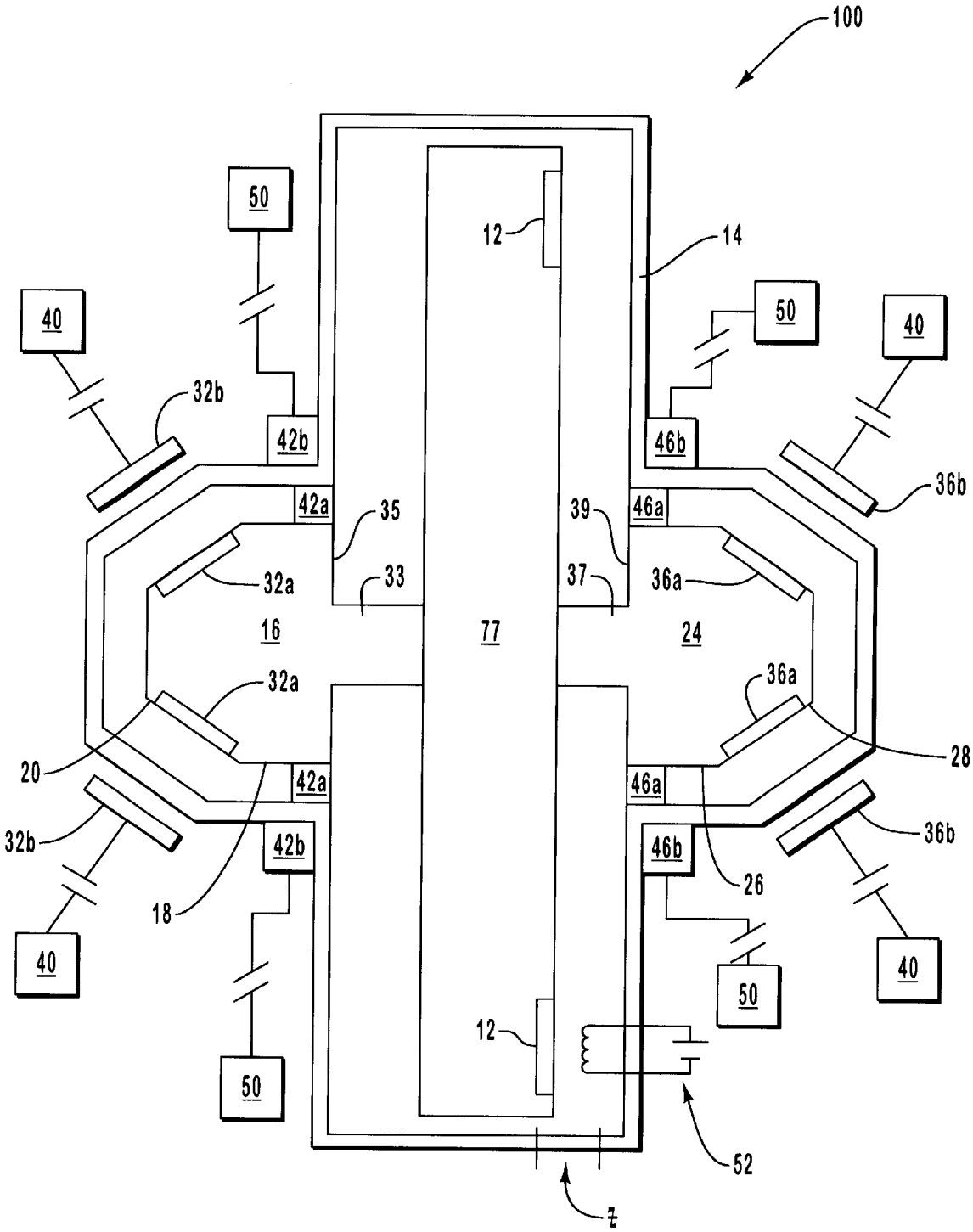
FIG. 2 is a cross sectional drawing of another embodiment of the present invention that is similar to the embodiment seen in FIG. 1 with the exception that the anode assumes a different shape and function and is intended to operate at a higher temperature than the anode of FIG. 1.

The embodiment of an x-ray generator 100 that is seen in FIG. 2 preferably will be operated at a temperature in a range from 500° C. to about 1200° C. At this operating temperature range, heat is removed from track 12 primarily by radiation. Specifically, track 12 and disk 77 radiate heat to objects within vacuum tube 14. One such object includes an emissive coating that is upon most surfaces within vacuum tube 14 including disk 77. The emissive coating on parts within vacuum tube 14 enables a black body effect for efficient radiation of heat so as to remove heat from x-ray generator 100. The heat stops 33 and 37 are devices which prevent conduction of heat into the magnetic bearings. Heat stops are well known to those skilled in the art and the simplest form is shown in FIG. 2. In particular, when the cross-sectional area of the heat path is reduced, less heat can flow. Likewise, when the heat path is elongated, less heat can flow on the longer path. Heat stops 33 and 37 have small cross sectional areas compared to 16 and 24 and have long heat parts compared to 16 and 24. Generally the amount of heat entering the left and right portions 16 and 24 is fixed by the ability of 42*a* and 46*a* to remove it. The size and shape of 33 and 37 are therefor chosen to match the heat flow into 16 and 24 with this design value using a 1200° C. maximum temperature target.

Figure 3:
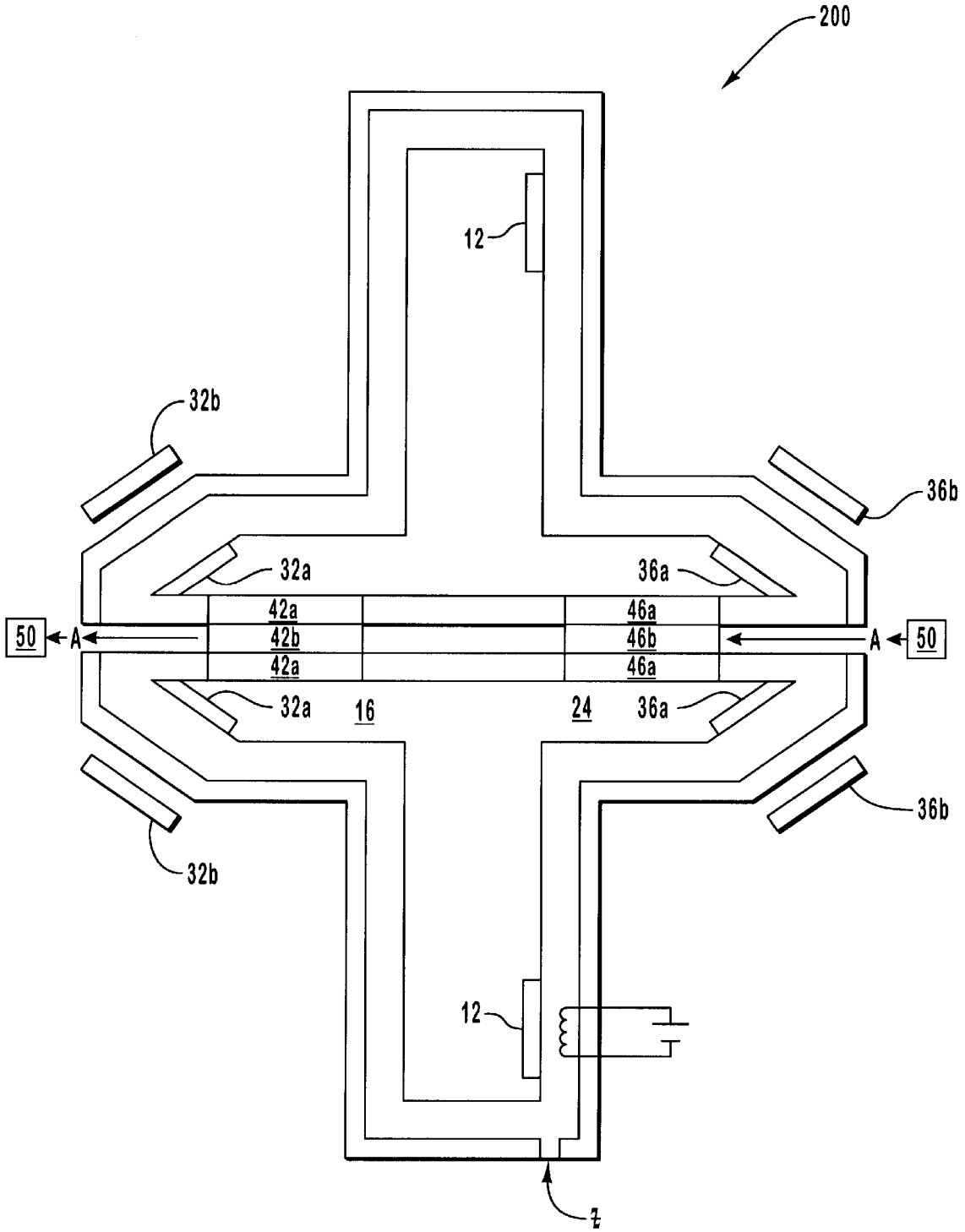
FIG. 3 is a cross sectional drawing of another embodiment of the present invention that is adapted for a cooling fluid to flow axially through a vacuum tube.

The embodiment of an x-ray tube 200 that is seen in FIG. 3 preferably will be operated at a temperature in a range from 0° C. to about 500° C. although it may be designed with the heat stops 33 and 37 shown in FIG. 2 that would allow target operating temperatures in the range of 1200° C. This embodiment shows that the liquid including a metal 42*a* <ad 46*a* is not constrained to any one specific area on the anode. As is shown, the areas of liquid metal 42*a* and 46*a* may be placed internal to 16 and 24 and they can communicate to conventional heat exchangers 50 as shown. The pipe on tie axis of the tube varies in size as the heat flow design requires. The elements 46*a* and 46*a* do not need to be separated from each other and may be combined to form a single entity. Similarly elements 42*b* and 46*b* may be combined to form a single entity.

A cooling fluid flows axially in FIG. 3 through elements 16 and 24 as is indicated by an arrow A. The cooling fluid is preferably in thermal communication with a conventional heat exchanger such as is represented at reference numeral 50.

Figure 4:
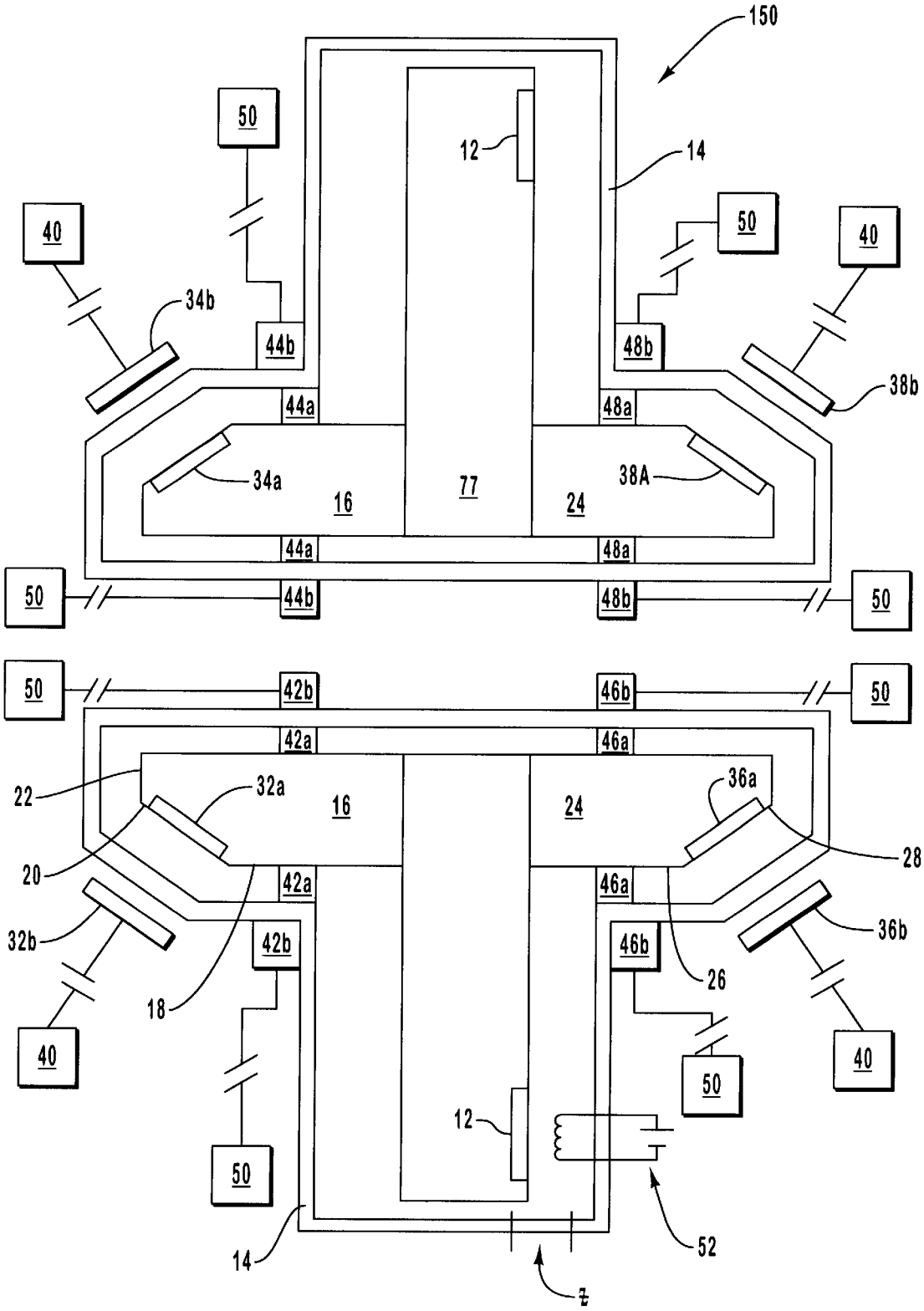
FIG. 4 is a cross sectional drawing of yet another embodiment of the present invention showing a hollow shape extending symmetrically through of a vacuum tube.

FIG. 4 shows an alternative embodiment 150 seen in cross section through the center of vacuum tube 14 in which a hollow region extending through vacuum tube 14 is illustrated as being symmetric about the axis of rotation of the anode. For purposes of heat transfer from anode 16, 24, a liquid including a metal at reference numerals 42*a*, 42*b*, 44*a*, 44*b*, 46*a*, 46*b*, 48*a*, and 48*b* is in an annular configuration that is in contact with various portions of anode 16, 24, and vacuum tube 14. The liquid including a metal seen at 42*b*, 44*b*, 46*b*, and 48*b* are in thermal communication with conventional heat exchangers represented at reference numeral 50.

In the preferred embodiments of FIGS. 1–4, the areas of liquid metal that are used to conduct heat from a surface of the anode are substantially confined within a defined area along an outer surface of the anode. This is accomplished, for example in the embodiment of FIG. 1, by placing a first film along each of the outer surfaces of the cylindrical sections 18 and 26 that are to be adjacent to the liquid metal 42*a* and 46*a*. The film can be composed of any material that has an affinity for the particular material used in the liquid metal, such that the liquid metal tends to stay in contact with the film. For example, molybdenum, tool steel, tungsten, or silicon dioxide could be used. In addition, the liquid metal 42*a* and 46*a* is confined within the defined area along the respective cylindrical section 18 and 26 by placing a second film layer on both sides of the first film layer. Preferably, the second film is comprised of a material that does not have an affinity (i.e., tends to repel) the liquid metal, further influencing the liquid metal to stay within a prescribed boundary area. The second film can be composed of graphite, molybdenum carbide, titanium dioxide, silicon nitride, silicon carbide, or aluminum oxide.

Figure 5:
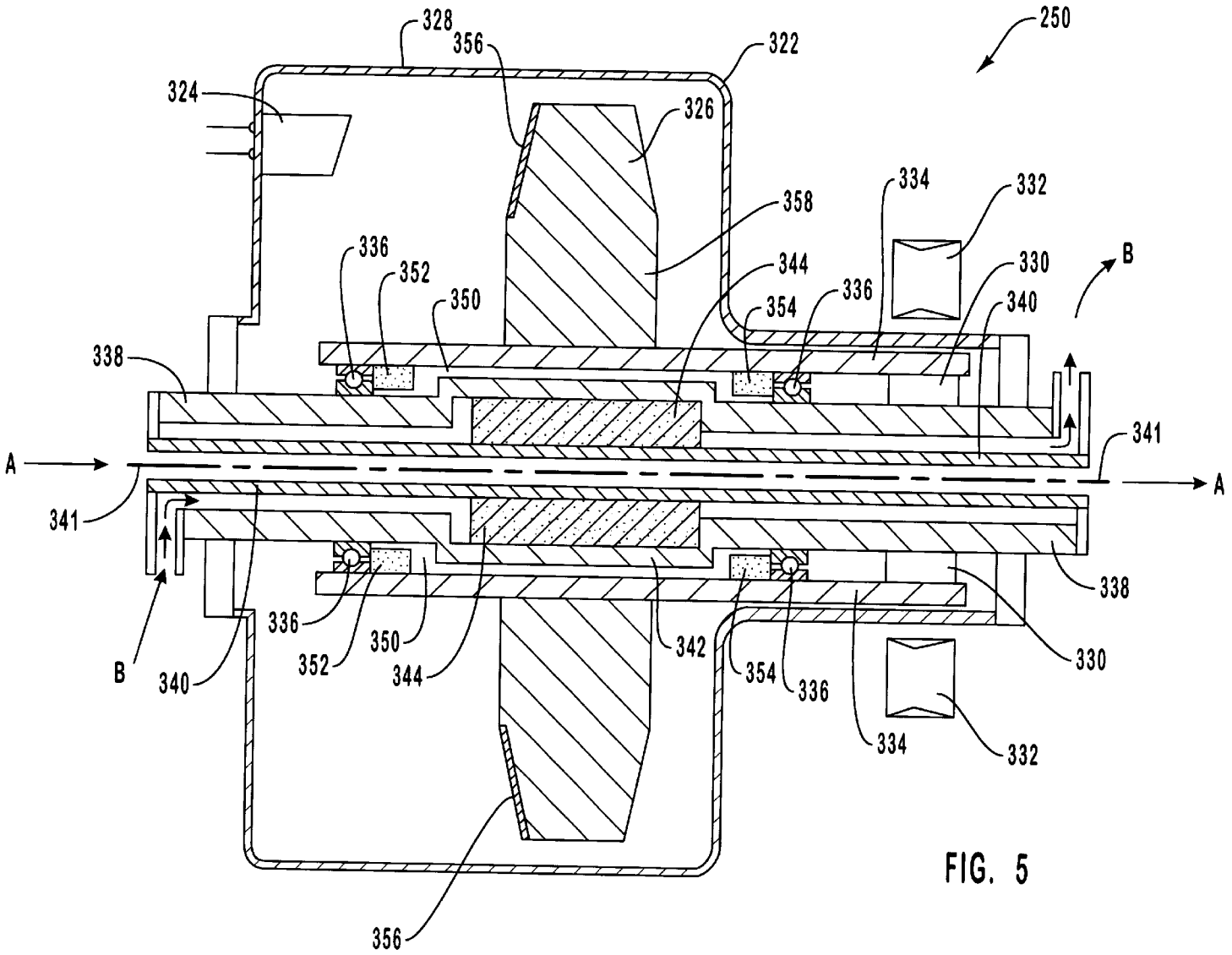
FIG. 5 is a cross sectional drawing of still another embodiment of the present invention adapted for a first and a second cooling fluids in flowing separate parts through a vacuum tube.

Reference is now made to FIG. 5, which illustrates a further embodiment of the invention, designated generally at 250. Illustrated is a vacuum envelope 322 containing a cathode 324, a rotating anode 326, an X-ray transparent window 328 and a motor structure including a rotor winding 330 and an external stator winding 332. Rotor winding 330 is carried by a rotating sleeve 334 on which anode 326 is mounted. As an alternative, rotor winding 330 may be carried on the outer diameter of rotating sleeve 334. Sleeve 334 is carried by and is designed to regulate the heat flow to a plurality of magnetic bearings 336 so as to prevent the same from exceeding their Curie Point. The plurality of magnetic bearings 336 are mounted on a stationary tube 338, fixedly attached to the wall of vacuum envelope 322. Fixedly mounted within tube 338 is a pipe 340 having an axis 341 through which a first cooling fluid, which is preferably water, flows axially in a path indicated as an arrow A in FIG. 5. A second cooling fluid flows in a path indicated as an arrow B in FIG. 5. First and second cooling fluids arc preferably in thermal communication with a conventional heat exchanger such as is represented in FIG. 1 at reference numeral 50. The composition of the first and second cooling fluids can be the same or different and arc selected based upon thermodynamic design criteria known to those of skill in the art.

All of rotating sleeve 334, tube 338, and pipe 340 are coaxial with the X-ray tube's longitudinal axis. Tube 338 includes enlarged cylindrical portion 342 axially aligned with anode 326. A cylindrical heat exchanger 344 is located between the interior wall of an enlarged portion 342 and the exterior wall of pipe 340. A high thermal conductance path is provided between the exterior wall of heat exchanger 344 and anode 326 by a liquid metal film in a gap 350 between the exterior of enlarged cylindrical portion 342 and rotating sleeve 334. The liquid metal film in gap 350 is confined to the gap by labyrinths 352 and 354, positioned between tube 338 and sleeve 334, just beyond the shoulders of enlarged cylindrical portion 342.

Anode 326 is made of high thermal conductivity material, preferably copper, molybdenum or tungsten. An anode track 356 is tungsten or other material with a high atomic number for the production of Bremstrahlung X-rays. Heat generated by electron bombardment of track 356 flows through body 358 and sleeve 334, across liquid metal film in gap 350 to heat exchanger 344.

The embodiment of FIG. 5 can be adapted, through the depicted heat exchanging apparatus and appropriate methods of operation, to reduce the temperature at which anode 326 is operated. Various benefits arc achieved by such low temperature operation. One such benefit is that no emissive coatings are needed on the inside surface of the X-ray tube or on parts therein. Another benefit is that less expensive materials, that are capable for such low temperature operation, can be used for anode 326 and sleeve 334. A further benefit is that the evolution or out gassing of gas in the anode and other parts within the X-ray tube is reduced by virtue of the low temperature operation. Also, the failure of components due the elevation of high operational temperatures is thereby avoided.

In each of the inventive embodiments described herein, it is preferable that the anode be electrically grounded, particularly when using magnetic bearings. When an x-ray tube is used for CT scanning, especially for multi-slice scanning, the anode is at ground potential and the cathode is kept in a range from about 0 volts to about 150,000 volts. In prior art, the anode and die cathode are equal but opposite at a range from 0 volts to 75,000 volts, where the anode is positive and the cathode is negative. By grounding the anode the feedback circuit is prevented from experiencing electrical arcing and electrical shorts that would otherwise destroy the control circuitry.

In the low temperature embodiment, such as is seen in FIG. 1, the track material is preferred to incorporate rhenium doped tungsten, but disks including a non-refractory metal could be used. When operating at low temperatures, a less expensive material may be used for disk 77. Conversely, a high temperature operation as in FIG. 2, requires anode materials that will not melt during operation. For instance, an iron anode may be used as disk 77 as described in FIG. 1, in an x-ray tube having an anode operating at 500° C. or lower, and, less expensive manufacturing processes may also be used in the construction of the anode using less expensive materials.

Emissive coatings are typically not needed when an x-ray tube is operated below 500° C. because at that temperature the x-ray tube is not radiating significant amounts of heat. Above 500° C., an emissive coating is typically used to enhance the thermal radiation properties of die x-ray tube. When so enhanced, heat can be better removed from the x-ray tube by thermal radiation. The emissive coating should be applied to all elements for high temperature operation. Heat is absorbed by the emissive coating through thermal radiation and is thereby enhanced. It is also preferred to apply emissive coating on the rotating portion within an x-ray tube. As such, both rotating and non-rotating portions of the x-ray tube have an emissive coating thereon.

It is preferred that each embodiment of the inventive x-ray generation device incorporate a magnetic suspension device having a feedback system so as to control the position and rotation of the anode, as is illustrated at reference numeral 40. This system articulates or otherwise causes the track to move. The temperature of the anode and the temperature of the magnetic suspension may be assessed by thermocouples or other remote sensing devices that pick up the temperature and deliver a signal corresponding thereto to the feedback system. While it is not necessary to control temperature for the provision of feedback, the temperature of these areas are related to the feedback system.

It is preferable to communicate the temperature of these devices because temperature determines how the system is being operated. For instance, it can determine how much heat the system can withstand. Assuming that a target is at 200° C., a significant amount of energy will be required to heat up the target to 450° C. if that is the operating temperature. The location of the anode rotating within die vacuum tube can be controlled magnetically through the feedback system. The location of the rotating anode in the vacuum tube can be dependent upon temperature because the materials deform, swell, or otherwise change shape as they heat and cool. The feedback system encourages the controlled operation of the system and the maximization of the amount of energy that is put into the vacuum tube, as well as the monitoring of that energy.

A further theory of the present invention is that it is preferable that the anode is directly cooled in a liquid metal by thermal conduction as it rotates in a magnetic contactless bearing. The thermal conduction prevents the materials in the rotating anode from being heated past their Curie point and losing their magnetic properties. In the operation and control of the contactless bearing that magnetically suspends the anode within the tube during the axial rotation thereof, it is preferable that the anode be positioned by a magnetic suspension device and feedback system that provides constant scanning or multiple position scanning. As such, the position of the focal spot on the track surface of the anode may be altered as needed for constant scanning or for multiple position scans where each scan, or part of a scan, may be spatially separated from the other scan or part of the scan. This benefit results in a more efficient use and longer life of the track surface on the anode.

Embodiments of the present invention provide a cooling system in which a rotating anode is directly cooled by thermal conduction through a liquid metal. As such, the x-ray tube can sustain higher average heat loads during operation and an x-ray clinician operating the tube can use the tube to produce more x-ray images each day. Since the rotating anode is directly cooled through the liquid metal, the materials in the rotating member do not overheat past their Curie point and lose their magnetic properties. As such, the x-ray generator can be operated at lower temperatures, such as not more that about 500° C., as compared to conventional x-ray tubes which operate as hot as 1200° C. Lower temperature operation provides better track loading as well as a better loading repetition rate.

The inventive apparatus and method can also be used where a rotating member picks up excessive heat during its operation. For instance, turbines that arc used in vacuum pump and turbines that are used in gas liquification could be considered for the present apparatus and method. Any turbine, any rotating member, including a magnetized rotating member that is subject to overheating, could use the present apparatus and method to prevent overheating that would ultimately hinder the operation of the application. In general, high vacuum tubes having rotating members therein can use the present apparatus and method to remove heat.

The present invention may be embodied in other specific form is without departing from its spirit or essential characteristics. The described embodiments are to be considered in all respects only as illustrated and not restrictive. The scope of the invention is, therefore, indicated by the appended claims rather than by the foregoing description. All changes which come within die meaning and range of equivalency of the claims are to be embraced within their scope.

What is claimed and desired to be secured by United States Letters Patent is:

1. An X-ray generation device comprising:

a tube having a sub-atmospheric pressure therein;

an anode within the tube and having a track surface;

a cathode within the tube to direct electrons to the track surface and produce x-rays;

a contactless bearing for magnetically journaling the anode;

a device for axially rotating the anode within the contactless bearing;

a first liquid including a metal confined within a fixed configuration in contact with the anode and the tube for thermal heat conduction from the anode to the tube.

2. The x-ray generation device as defined in claim 1, further comprising:

a second liquid including a metal in thermal heat conduction relation with the first liquid, said first and second liquids being separated by and in contact with the tube.

3. The x-ray generation device as defined in claim 2, wherein the second liquid is confined in a fixed configuration conforming to that of the first liquid.

4. The x-ray generation device as defined in claim 1, wherein the anode is hollow.

5. The x-ray generation device as defined in claim 2, wherein the second liquid is in thermal heat conduction relation with a heat exchanger to move heat away from the second liquid.

6. The x-ray generation device as defined in claim 5, wherein the heat exchanger is selected from the group consisting of thermally conductive air cooled fin structures, thermally conductive conduits for conducting fluid therethrough and communicating heat to the fluid moving within the conduits, and thermally conductive conduits within a positively cooled environment.

7. The x-ray generation device as defined in claim 1, wherein:

the tube has an inner surface; and the inner surface of the tube and the outer surface of the anode each include:

a film composed of a material that is wet by the first liquid and assumes a configuration conforming to the fixed configuration within which the first liquid is confined; and a peripheral material to the film that is not wet by the first liquid, wherein the first liquid is confined within a boundary defined by the peripheral material.

8. The x-ray generation device as defined in claim 7, wherein the material of which the film is composed is selected from the group consisting of molybdenum, tool steel, tungsten, and silicon dioxide.

9. The x-ray generation device as defined in claim 7, wherein the peripheral material is composed of a material selected from the group consisting of graphite, molybdenum carbide, titanium dioxide, silicon nitride, silicon carbide, and aluminum oxide.

10. The x-ray generation device as defined in claim 7, wherein the metal included in the first liquid is selected from the group consisting of gallium, indium, tin, and a gallium-indium-tin alloy.

11. The x-ray generation device as defined in claim 7, wherein the boundary defined by the peripheral material on the outer surface of the anode includes a lip projecting from the outer surface of the anode.

12. The x-ray generation device as defined in claim 1, wherein the anode has an outer surface including a lip projecting therefrom that assumes a configuration conforming to the fixed configuration within which the first liquid is confined.

13. The x-ray generation device as defined in claim 1, wherein the tube has an inside surface that is free of thermally emissive coatings.

14. The x-ray generation device as defined in claim 1, wherein the anode further comprises:

an anode disk having said track surface thereon;

a first cylindrical section extending from the anode disk to terminate at first circular surface having a diameter greater than the first cylindrical section, the first circular surface having a first cooling cylindrical section extending therefrom to terminate at a first frustroconical section, said first frustroconical section extending to terminate a first end;

a second cylindrical section extending from the anode disk to terminate at second circular surface having a diameter greater than the second cylindrical section, the second circular surface having a second cooling cylindrical section extending therefrom to terminate at a second frustroconical section, said second frustroconical section extending to terminate a second end opposite the first end.

15. The x-ray generation device as defined in claim 14, wherein the second cooling cylindrical section and the second cooling cylindrical section each are in contact with the first liquid.

16. The x-ray generation device as defined in claim 14, wherein the contactless bearing for magnetically journaling the anode comprises:

a first inside magnetic component within the first frustroconical section magnetically held in a spaced relation to a first outside magnetic component that is situated outside of the tube; and a second inside magnetic component within the second frustroconical section magnetically held in a spaced relation to a second first outside magnetic component that is situated outside of the tube.

17. The x-ray generation device as defined in claim 14, wherein:

the first and second frustroconical sections include, respectively, a first and a second magnetic mass;

the tube has outside thereof a first and a second magnetic component; and the first magnetic mass and the second magnetic mass are magnetically held, respectively, in a spaced relation by and with the first magnetic component and the second magnetic component;

the anode is suspended axially and radially in a spaced relation with the tube.

18. The x-ray generation device as defined in claim 14, wherein the tube has an inside surface having a thermally emissive coating thereon to absorb heat.

19. The x-ray generation device as defined in claim 1, wherein the anode is symmetrical about the axis that said anode axially rotates within the contactless bearing.

20. The x-ray generation device as defined in claim 1, wherein the cathode is in electrical communication with a controller for the control of multiple slice scanning by said cathode upon said track surface.

21. The x-ray generation device as defined in claim 1, further comprising a feed back system in electrical and thermal communication with the contactless bearing for magnetically journaling the anode, said feed back system controlling the contactless bearing to magnetically suspend the anode in a spaced relation with the tube while the anode is rotating within the contactless bearing.

22. The x-ray generation device as defined in claim 21, wherein said feed back system controls the contactless bearing to magnetically move the anode for the purpose of maintaining alignment of the x-ray source.

23. The x-ray generation device as defined in claim 21, wherein the feed back system magnetically moves the anode to new positions for the purpose of providing multiple origins for the x-rays for multi-slice tomography.

24. The x-ray generation device as defined in claim 1, further comprising an anode-grounding device for electrically setting the anode at ground potential.

25. The x-ray generation device as defined in claim 1, wherein the anode further comprises:

an anode disk having said track surface thereon and a thermal heat conductivity;

a first heat stop section having a thermal heat conductivity lower than that of the anode disk and extending from the anode disk to terminate at the material wetted by the first liquid, the material wetted by the first liquid extends to materials that support the magnetic bearing material and that a higher thermal conductivity than the anode disk;

a second heat stop section having a thermal heat conductivity lower than that of the anode disk and extending from the anode disk to terminate at the material wetted by the first liquid, wherein the material wetted by the first liquid extends to materials that support the magnetic bearing material and that have a thermal conductivity that is higher than that of the anode disk.

26. The x-ray generation device as defined in claim 1, wherein the anode further comprises:

an anode disk having said track surface thereon and a thermal heat conductivity;

a first heat conduction section having a thermal heat conductivity higher than that of the anode disk and extending from the anode disk to terminate at the material wetted by the first liquid, wherein the material wetted by the first liquid support the magnetic bearing material and extends to a material with a thermal conductivity that is higher than that of the anode disk;

a second heat conduction section having a thermal heat conductivity higher than that of the anode disk and extending from the anode disk to terminate at the material wetted by the first liquid, wherein the material wetted by the first liquid supports the magnetic bearing material and extends to a material with a thermal conductivity that is higher than that of the anode disk.

27. The x-ray generation device as defined in claim 26, wherein the first and second heat conduction sections terminate at the material wetted by the first liquid and are separated from the material that supports the magnetic bearing material by a material having a lower thermal conductivity that of the first and second heat conduction sections.

28. An x-ray generation device comprising:

a vacuum tube;

a rotary anode in the vacuum tube and magnetically journaled in a contactless bearing, said rotary anode having an outer surface and including:

an anode disk;

a first portion having first frustroconical section extending from the anode disk to a first cylindrical section, said first cylindrical section extending to terminate at a first end;

a second portion having second frustroconical section extending from the anode disk to a second cylindrical section, said second cylindrical section extending to terminate at a second end; and a track positioned between the first and second ends;

a cathode in the vacuum tube in electrical communication with a power source for the generation of an electron beam from the cathode directed at the track for the production of an x-ray therefrom;

a mechanism for electromagnetically rotating the rotary anode within the contactless bearing;

magnetic bearing materials contained in the first and second cylindrical ends;

a first liquid including a metal confined within a fixed configuration around and in contact with the outer surface of the rotary anode for thermal heat conduction therefrom.

29. An x-ray generation device as defined in claim 28, wherein:

a hollow cylindrical shape that extends through the first cylindrical section, the first frustroconical section, the anode disk, the second frustroconical section, and the second cylindrical section;

said cylindrical shape surrounds a cylindrical tube which carries:

the first liquid in thermal relation to the first cylindrical section, the first frustroconical section, the anode, the second frustroconical section, and the second cylindrical section; and a second liquid in thermal relation to the first liquid, said cylindrical tube also communicating the second liquid to heat exchange devices.

30. An x-ray generation device comprising:

a vacuum tube;

a rotary anode in the vacuum tube and magnetically journaled in a contactless bearing, said rotary anode having an outer surface and comprising:

a first portion having first cylindrical section extending from the anode to a first frustroconical section, said first frustroconical section extending to terminate at a first end;

a second portion having second cylindrical section extending from the anode to a second frustroconical section, said second frustroconical section extending to terminate at a second end opposite the first end; and a track positioned between the first and second ends;

a cathode in the vacuum tube in electrical communication with a power source for the generation of an electron beam from the cathode directed at the track for the production of an x-ray therefrom;

a mechanism for electromagnetically rotating the rotary anode within the contactless bearing;

a first liquid including a metal confined within a fixed configuration around and in contact with the outer surface of the rotary anode for thermal heat conduction therefrom.

31. The x-ray generation device as defined in claim 30, further comprising:

a second liquid including a metal in thermal heat conduction relation with first liquid and confined in a fixed configuration conforming to that of the first liquid, said the first and second liquids being separated by and in contact with the vacuum tube; and a heat exchanger for moving heat from the second liquid and outside the vacuum tube.

32. The x-ray generation device as defined in claim 30, wherein the tube has an inside surface that is free of thermally emissive coatings.

33. An x-ray generation device comprising:

a vacuum tube;

a rotary anode in the vacuum tube and magnetically journaled in a contactless bearing, said rotary anode having an outer surface thereon, said rotary anode comprising:

a first cylindrical section extending from the anode to terminate at first circular surface having a diameter greater than the first cylindrical section, the first circular surface having a first cooling cylindrical section extending therefrom to terminate at a first frustroconical section, said first frustroconical section extending to terminate a first end; and a second cylindrical section extending from the anode to terminate at second circular surface having a diameter greater than the second cylindrical section, the second circular surface having a second cooling cylindrical section extending therefrom to terminate at a second frustroconical section, said second frustroconical section extending to terminate a second end opposite the first end;

a cathode in the vacuum tube in electrical communication with a power source for the generation of an electron beam from the cathode directed at the track for the production of an x-ray therefrom;

a mechanism for electromagnetically rotating the rotary anode within the contactless bearing;

a first liquid including a metal confined within a fixed configuration around and in contact with the first and second cooling cylindrical sections for thermal heat conduction therefrom;

a second liquid including a metal in thermal heat conduction relation with first liquid and confined in a fixed configuration conforming to that of the first liquid, said the first and second liquids being separated by and in contact with the vacuum tube; and a heat exchanger for moving heat from the second liquid and outside the vacuum tube.

34. The x-ray generation device as defined in claim 33, wherein the tube has an inside surface having a thermally emissive coating thereon to absorb heat.

35. An x-ray generation device comprising:

a tube having a sub-atmospheric pressure therein;

an anode within the tube and having an outside surface and a track surface;

means for magnetically suspending the anode within the tube;

means for axially rotating the anode within the tube;

means for directing an electron beam on the track surface to produce an x-ray;

means, in contact with the tube and the outside surface of the anode and including a first liquid metal, for thermal heat conduction from the anode;

means, situated upon the tube and including a second liquid metal, for thermal heat conduction from the first liquid away from the tube, wherein said the first and second liquids are separated by and in contact with the tube.

36. An x-ray generation device comprising:

a tube having a sub-atmospheric pressure therein, the tube having an inner surface, the inner surface having thereon a film composed of a first material that assumes a configuration that is confined within a boundary defined by a peripheral material on the inner surface;

an anode defined about an axis and situated within the tube, said anode having a track surface and an outer surface having thereon a film composed of said first material that assumes a configuration that is confined within a boundary defined by said peripheral material on the outer surface, wherein the boundary on outer surface of the anode conforms to the boundary on the inner surface of the tube;

means, including a plurality of ferromagnetic components on the anode and outside of the tube, for magnetically suspending the anode within the tube;

means for electromagnetically rotating the anode about the axis;

means, including a cathode within the tube, for directing an electron beam on the track surface to produce an x-ray;

means, including a first liquid metal on the outer surface of the anode that is wet by the first material but not wet by the peripheral material and that is fixed within a configuration conforming to the configuration of the first material, for thermal heat conduction from the anode;

means, including a second liquid metal, for thermal heat conduction from the first liquid and away from the tube, wherein said the first and second liquids are separated by and in contact with the tube.

37. A method of generating an x-ray, the method comprising:

providing a tube having therein:

a sub-atmospheric pressure;

an anode having an outside surface and a track surface;

a first liquid including a metal confined within a fixed configuration in contact with an outside surface of the anode for thermal heat conduction therefrom; and a cathode, wherein said tube having thereon a second liquid including a metal in thermal heat conduction relation with the first liquid and confined in a fixed configuration conforming to that of the first liquid, said first and second liquids being separated by and in contact with the tube;

magnetically suspending the anode within the tube in a contactless bearing;

axially rotating the anode within the contactless bearing;

directing an electron beam produced by the cathode to the track surface, wherein:

the track surface increases in temperature and produces an x-ray when contacted by the electron beam while the anode is rotating within the contactless bearing;

the first liquid removes heat by thermal conduction from the anode;

the second liquid removes heat by thermal conduction from the first liquid.

38. The method as defined in claim 37, further comprising:

removing heat from the second liquid by a heat exchanger that moves heat away from the second liquid and outside of the tube.

39. The method as defined in claim 38, wherein the heat exchanger is selected from the group consisting of thermally conductive air cooled fin structures, thermally conductive conduits for conducting fluid therethrough and communicating heat to the fluid moving within the conduits, and thermally conductive conduits within a positively cooled environment.

40. The method as defined in claim 37, further comprising:

performing multiple slice scanning with the cathode upon said track surface.

41. The method as defined in claim 37, further comprising:

electrically communicating the temperature and electrical characteristics of the contactless bearing to a feed back system;

using said feed back system to control the contactless bearing in the magnetic suspension of the anode in a spaced relation within the tube while the anode is rotating within the contactless bearing.

42. The method as defined in claim 37, further comprising:

electrically setting the anode at ground potential while the feed back system controls the contactless bearing in the magnetic suspension of the anode in a spaced relation within the tube while the anode is rotating within the contactless bearing.

43. A method of generating an x-ray, the method comprising:

providing a tube having therein:

a sub-atmospheric pressure;

an anode having an outside surface and a track surface, the anode comprising:

a first cylindrical section extending from the anode to a first frustroconical section, said first frustroconical section extending to terminate at a first end;

a second cylindrical section extending from the anode to a second frustroconical section, said second frustroconical section extending to terminate at a second end opposite the first end;

a first liquid including a metal confined within a fixed configuration in contact with the first and second cylindrical sections for thermal heat conduction therefrom;

a cathode, wherein said tube has thereon a second liquid including a metal in thermal heat conduction relation with the first liquid and confined in a fixed configuration conforming to that of the first liquid, said first and second liquids being separated by and in contact with the tube;

magnetically suspending the anode within the tube in a contactless bearing;

axially rotating the anode within the contactless bearing;

directing an electron beam produced by the cathode to the track surface, wherein:

the track surface increases in temperature and produces an x-ray when contacted by the electron beam while the anode is rotating within the contactless bearing;

the first liquid removes heat by thermal conduction from the anode;

the second liquid removes heat by thermal conduction from the first liquid and through the tube.

44. The method as defined in claim 43, wherein:

the anode includes a first inside magnetic component within the first frustroconical section and a second inside magnetic component within the second frustroconical section;

the tube has outside thereof a first outside magnetic component and a second magnetic component; and magnetically suspending the anode within the tube in the contactless bearing comprises:

magnetically holding in a spaced relation:

the first inside magnetic component from the first outside magnetic component; and the second magnetic component from the second outside magnetic component.

45. The method as defined in claim 43, further comprising:

controlling the temperature of the contactless bearing to be not greater than about 500 degrees Centigrade when the x-ray is produced.

46. The method as defined in claim 44, further comprising controlling the temperature of:

the first inside magnetic component;

the second inside magnetic component;

the first outside magnetic component; and the second outside magnetic component to be not greater than about 500 degrees Centigrade when the x-ray is produced.

47. A method of generating an x-ray, the method comprising:

providing a tube having therein:

a sub-atmospheric pressure;

an anode having an outside surface and a track surface, the anode comprising:

a first cylindrical section extending from the anode to terminate at first circular surface having a diameter greater than the first cylindrical section, the first circular surface having a first cooling cylindrical section extending therefrom to terminate at a first frustroconical section, said first frustroconical section extending to terminate a first end;

a second cylindrical section extending from the anode to terminate at second circular surface having a diameter greater than the second cylindrical section, the second circular surface having a second cooling cylindrical section extending therefrom to terminate at a second frustroconical section, said second frustroconical section extending to terminate a second end opposite the first end;

a first liquid including a metal confined within a fixed configuration in contact with the first and second cooling cylindrical sections for thermal heat conduction therefrom; and a cathode, wherein said tube has thereon a second liquid including a metal in thermal heat conduction relation with the first liquid and confined in a fixed configuration conforming to that of the first liquid, said first and second liquids being separated by and in contact with the tube;

magnetically suspending the anode within the tube in a contactless bearing;

axially rotating the anode within the contactless bearing;

directing an electron beam produced by the cathode to the track surface to increase the temperature of the track surface and produce an x-ray while the anode is rotating within the contactless bearing;

thermally conducting heat from the anode through the he first liquid;

thermally conducting heat from the first liquid through the tube to the second liquid.

48. The method as defined in claim 47, further comprising:

controlling the temperature of the contactless bearing to be not less than about 1200 degrees Centigrade when the x-ray is produced.

49. The method as defined in claim 47, wherein:

the anode includes a first inside magnetic component within the first frustroconical section and a second inside magnetic component within the second frustroconical section;

the tube has outside thereof a first outside magnetic component and a second magnetic component; and magnetically suspending the anode within the tube in the contactless bearing comprises:

magnetically holding in a spaced relation:

the first inside magnetic component from the first outside magnetic component; and the second magnetic component from the second outside magnetic component.

50. The method as defined in claim 49, further comprising controlling the temperature of:

the first inside magnetic component;

the second inside magnetic component;

the first outside magnetic component; and the second outside magnetic component to be not less than about 1000 degrees Centigrade when the x-ray is produced.

51. The method as defined in claim 49, further comprising controlling the temperature of:

the first inside magnetic component;

the second inside magnetic component;

the first outside magnetic component; and the second outside magnetic component to be not more than the Curie points thereof when the x-ray is produced.

* * * * *

UNITED STATES PATENT AND TRADEMARK OFFICE

CERTIFICATE OF CORRECTION

PATENT NO. : 6,327,340 B1
APPLICATION NO. : 09/430482
DATED : December 4, 2001
INVENTOR(S) : Runnoe It is certified that error appears in the above-identified patent and that said Letters Patent is hereby corrected as shown below:

Column 1
Line 42, change “designate” to --designated--
Line 67, change “temperatures” to --temperature--

Column 3
Line 53, change “die” to --the--

Column 4
Line 56, remove “of”
Line 66, after “example of” insert --the--

Column 6
Line 51, change “<ad” to --and--
Line 55, change “tie” to --the--
Line 56, after “elements” change “46a” to --42a--

Column 7
Line 48, change “arc” to --are--
Line 52, _change “arc” to --are--

Column 8
Line 11, change “arc” to --are--
Line 20, after “due” insert --to--
Line 51, change “die” to --the--

Column 9
Line 3, change "are" to --is--
Line 11, change "die" to --the--
Line 54, change "arc" to --are--
Line 64, change "form is" to --forms--
Line 66, change "illustrated" to --illustrative--

Column 10
Line 2, change "die" to --the--

Column 12
Line 56, after "conductivity" insert --than--

UNITED STATES PATENT AND TRADEMARK OFFICE

CERTIFICATE OF CORRECTION

PATENT NO. : 6,327,340 B1
APPLICATION NO. : 09/430482
DATED : December 4, 2001
INVENTOR(S) : Runnoe It is certified that error appears in the above-identified patent and that said Letters Patent is hereby corrected as shown below:

Column 18
Line 8, after "through the" remove "he"

Signed and Sealed this

Seventeenth Day of October, 2006

JON W. DUDAS
*Director of the United States Patent and Trademark Office*